US006885377B2

(12) United States Patent
Lim et al.

(10) Patent No.: US 6,885,377 B2
(45) Date of Patent: Apr. 26, 2005

(54) IMAGE DATA OUTPUT CONTROLLER USING DOUBLE BUFFERING

(75) Inventors: Chae-Whan Lim, Kumi-shi (KR); Soon-Jin Kim, Kumi-shi (KR)

(73) Assignee: Samsung Electronics Co., Ltd. (KR)

( * ) Notice: Subject to any disclaimer, the term of this patent is extended or adjusted under 35 U.S.C. 154(b) by 175 days.

(21) Appl. No.: 10/278,291

(22) Filed: Oct. 23, 2002

(65) Prior Publication Data

US 2003/0095125 A1 May 22, 2003

(30) Foreign Application Priority Data

Nov. 19, 2001 (KR) ..... 2001-71890

(51) Int. Cl.[7] ..... G09G 5/399

(52) U.S. Cl. ..... 345/539; 345/531; 345/532; 345/537

(58) Field of Search ..... 345/539, 531, 345/532, 562, 537

(56) References Cited

U.S. PATENT DOCUMENTS 5,347,634 A * 9/1994 Herrell et al. ..... 345/539
5,438,376 A * 8/1995 Watanabe ..... 348/714
6,100,906 A * 8/2000 Asaro et al. ..... 345/539
6,252,572 B1 6/2001 Kurumisawa et al.

* cited by examiner

*Primary Examiner*—Matthew C. Bella
*Assistant Examiner*—Joni Hsu
(74) *Attorney, Agent, or Firm*—Dilworth & Barrese LLP

(57) ABSTRACT

An image data output control apparatus for enhancing a screen update speed to naturally update a screen is provided. The image data output control apparatus comprises first and second memories each for buffering image data of one screen, a host processor for selecting the first and second memories alternately as a display buffer for output of image data of a current screen and a screen buffer for storage of image data of a subsequent new screen, writing the image data of the subsequent screen into the screen buffer to construct the subsequent screen, and outputting the image data of the current screen stored in the display buffer. An output terminal outputs image data from any one of the first and second memories as image data for a screen to be displayed through a display unit.

3 Claims, 5 Drawing Sheets

IMAGE DATA OUTPUT CONTROLLER USING DOUBLE BUFFERING

PRIORITY

This application claims priority to an application entitled "IMAGE DATA OUTPUT CONTROLLER USING DOUBLE BUFFERING", filed in the Korean Industrial Property Office on Nov. 19, 2001 and assigned Serial No. 2001-71890, the contents of which are hereby incorporated by reference.

BACKGROUND OF THE INVENTION

1. Field of the Invention

The present invention relates to a portable terminal, and more particularly to an apparatus for controlling the output of image data to drive a display unit in a portable terminal with the display unit.

2. Description of the Related Art

A display unit, such as a liquid crystal display (LCD), is typically used in a portable terminal, such as a mobile telephone, personal digital assistant (PDA) or the like, to display images.

In such a portable terminal, as shown in FIG. 1, a host processor 100 outputs image data for a screen to be displayed through an LCD panel 106, to a display data buffer 104 in an LCD driver 102 to construct the screen. The host processor 100 is typically a microprocessor, and the display data buffer 104 is typically a video random access memory (RAM) for buffering image data on a screen basis. In the case where the portable terminal has an on-screen display (OSD) function, the host processor 100 also outputs OSD image data to an OSD application specific integrated circuit (ASIC) chip to construct a screen. On the other hand, for screen updating, the host processor 100 outputs image data for a new screen for every screen to the display data buffer to construct the new screen, so as to update a current screen with the new screen.

Recently, on the other hand, a color LCD has increasingly been employed as the display unit in the portable terminal as described above, and also in a moving image-type mobile communication terminal. In the case where the portable terminal has the color LCD, the host processor must output an increased amount of image data for display of one screen, with the increase in resolution of the color LCD. However, the microprocessor, which is used as the host processor in the portable terminal, is limited in its performance.

For this reason, the output of image data for a new screen for every screen to the display data buffer for screen updating acts as a load on the microprocessor, resulting in a reduction in processing rate thereof and, in turn, a screen ripple or flickering phenomenon, causing irritation to a user's eyes. For example, in the case where the user scrolls up or down on a menu screen, the entire screen must be updated. In this case, due to the limitations in the performance of the microprocessor employed in the portable terminal, the screen ripple phenomenon is visible to the user's eyes during the screen updating. Furthermore, when the scrolling is rapidly conducted, a screen update speed responsive thereto does not follow a user input speed. Moreover, when an incoming call animation, an outgoing call animation, etc. are displayed, the screen ripple or flickering phenomenon also occurs during the screen updating.

SUMMARY OF THE INVENT ION

In view of the above problems, it is an object of the present invention to provide an image data output control apparatus for enhancing a screen update speed to naturally update a screen even if the amount of image data for the screen to be outputted for display in a portable terminal is increased.

In accordance with the present invention, there is provided an image data output control apparatus for a portable terminal, for example, with a display unit. The apparatus in one aspect comprises first and second memories each for buffering image data of one screen. A host processor selects the first and second memories alternately as a display buffer for output of image data of a current screen and a screen buffer for storage of image data of a subsequent new screen. The host processor writes the image data of the subsequent screen into the screen buffer to construct the subsequent screen, and outputs the image data of the current screen stored in the display buffer. An output terminal outputs image data from any one of the first and second memories as image data for a screen to be displayed through the display unit. An access selector connects any one of the first and second memories, selected as the screen buffer by the host processor, to the host processor. A display selector connects the other one of the first and second memories, selected as the display buffer by the host processor, to the output terminal.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Now, preferred embodiments of the present invention will be described in detail with reference to the annexed drawings. In the following description, a detailed description of known functions and configurations incorporated herein will be omitted when it may make the subject matter of the present invention rather unclear.

Figure 1:
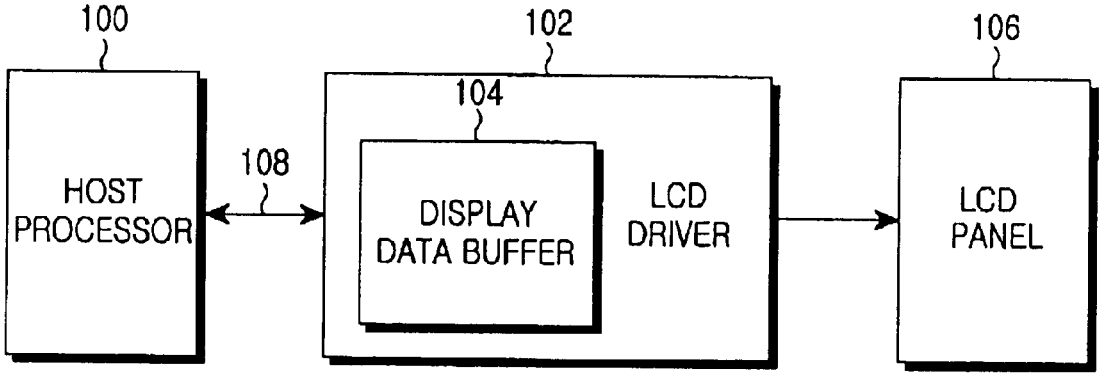
FIG. 1 is a block diagram showing a conventional arrangement for driving a display unit in a portable terminal.
Figure 2:
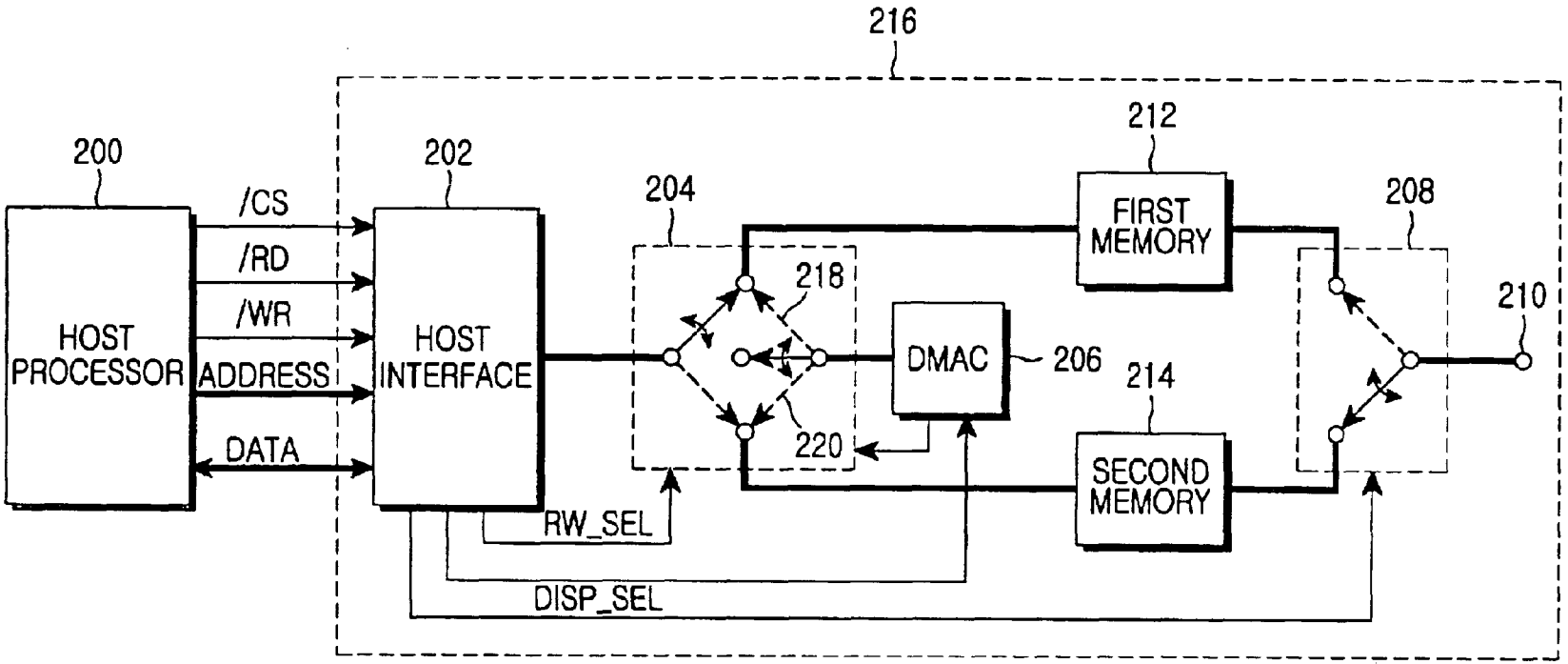
FIG. 2 is a block diagram showing the construction of an image data output control apparatus in accordance with the present invention.

With reference to FIG. 2, there is shown in block form the construction of an image data output control apparatus in accordance with the present invention. As shown in this drawing, the image data output control apparatus comprises a host processor 200, and a double buffering circuit 216 connected to the host processor 200 and having two video RAMs in terms of hardware for performing a double buffering process. The double buffering circuit 216 includes a host interface 202, an access selector 204, a direct memory access controller (DMAC) 206, a display selector 208, an output terminal 210, and first and second memories 212 and 214. In the case where the double buffering circuit 216 is employed in a portable terminal using an LCD as a display unit, it is included in an LCD driver or OSD ASIC or provided between the host processor 200 and the LCD driver or OSD ASIC. The first and second memories 212 and 214 are preferably video RAMs for storing image data on a screen basis.

In the image data output control apparatus with the above-mentioned construction, the host processor 200 selects one of the first and second memories 212 and 214 as a display buffer for outputting image data of a current screen, and the other as a screen buffer for storing image data of a subsequent new screen to construct the subsequent screen. After all the image data of the new screen are stored in the screen buffer, the host processor 200 exchanges the roles of the first and second memories 212 and 214 with each other. As a result, because the memory acting as the screen buffer is changed to the display buffer, it outputs the image data of the new screen stored therein to the display unit to display the new screen. Also, the memory which stored the image data of the screen previously displayed through the display unit is used as the screen buffer for constructing a new screen to be subsequently displayed through the display unit. In other words, under the condition that the screen of the image data stored in the display buffer is displayed, the subsequent screen to be updated is constructed in the screen buffer in advance. Then, the roles of the display buffer and screen buffer are exchanged with each other to update the displayed screen with the subsequent screen, resulting in an instantaneous screen shift being performed. Therefore, the image data output control apparatus according to the present invention can solve a conventional screen ripple or flickering phenomenon occurring because image data for a new screen for every screen is outputted to one display data buffer for screen updating.

In another aspect, the first and second memories 212 and 214 may store image data of frames adjacent in terms of time, and these frames may have many similar image data upon screen scrolling. In this case, the host processor 200 controls the DMAC 206 to fast block-copy the same portion of image data of a current screen, or image data stored in the display buffer, as that of image data of a new screen to the screen buffer in a hardware manner. Consequently, the new screen similar to the current screen can be more rapidly reconstructed by newly writing only the remaining image data portion into the screen buffer.

The access selector 204 and display selector 208 are used to perform a double buffering function of alternately selecting the first and second memories 212 and 214 as the display buffer and screen buffer with respect to every screen. The access selector 204 connects one of the first and second memories 212 and 214, selected as the screen buffer by the host processor 200, to the host processor 200 and selectively connects the first and second memories 212 and 214 to the DMAC 206 according to the operation of the DMAC 206. As a result, the host processor 200 can access the memory selected as the screen buffer. The display selector 208 connects the other one of the first and second memories 212 and 214, selected as the display buffer by the host processor 200, to the output terminal 210. The output terminal 210 outputs image data from the display buffer as image data for a screen to be displayed through the display unit. The output image data from the output terminal 210 is applied to an LCD driver in the case where the portable terminal employs an LCD as the display unit. Each of the access selector 204 and display selector 208 is preferably implemented with a multiplexer in terms of hardware.

The host interface 202 provides an interface for the access to the first and second memories 212 and 214 by the host processor 200 and the control of the access selector 204, DMAC 206, display selector 208 and first and second memories 212 and 214 by the host processor 200. Control commands from the host processor 200 are applied to the access selector 204, DMAC 206 and display selector 208 through the host interface 202. To this end, the host processor 200 and the host interface 202 are interconnected via an address bus and a data bus, and the host processor 200 applies a chip select signal /CS, a write signal /WR and a read signal /RD to the host interface 202. The host processor 200 also writes desired values into control registers provided in the host interface 202, as seen from the below table 1, to control the operations of the access selector 204, DMAC 206 and display selector 208, so as to control read/write operations of the first and second memories 212 and 214, although this is not shown in FIG. 2.

TABLE 1

| REGISTER | OBJECT TO BE CONTROLLED |
|---|---|
| RW_SEL | ACCESS SELECTOR (204) |
| DISP_SEL | DISPLAY SELECTOR (208) |
| BC_SEL 0 | DMAC (206) |
| BC_SEL 1 | DMAC (206) |
| BC_START | DMAC (206) |
| (BCX1, BCY1), (BCX2, BCY2) | DMAC (206) |
| (BCDX, BCDY) | DMAC (206) |

The access selector 204 connects the first memory 212 to the host processor 200 via the host interface 202 if the value of the register RW_SEL in the above table 1 is, for example, "1" in logic, and the second memory 214 to the host processor 200 via the host interface 202 if the value of the register RW_SEL is, for example, "0" in logic. The display selector 208 connects the first memory 212 to the output terminal 210 if the value of the register DISP_SEL is, for example, "1" in logic, and the second memory 214 to the output terminal 210 if the value of the register DISP_SEL is, for example, "0" in logic. Note that the values of the register RW_SEL and register DISP_SEL are different because the host processor 200 alternately selects the first and second memories 212 and 214 as the screen buffer and display buffer.

Figure 3A:
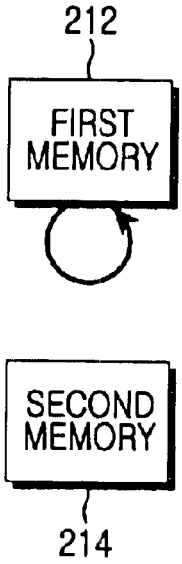
FIGS. 3A to 3D are views illustrating block copy operations of the image data output control apparatus in accordance with the present invention.
Figure 3B:
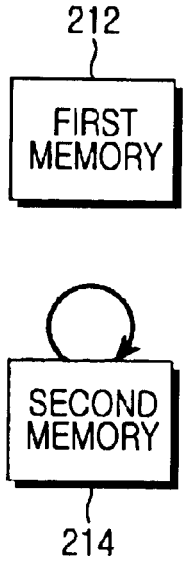
Figure 3C:
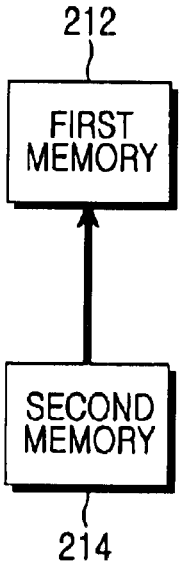
Figure 3D:
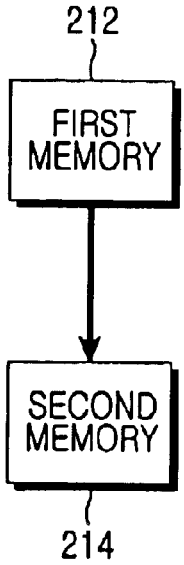

In the case where a block copy operation is required, the host processor 200 selects the first and second memories 212 and 214, respectively, as a source memory and a destination memory by combining the values of the register BC_SEL 0 and register BC_SEL 1 in the above table 1. The source memory stores original image data to be copied, and is designated by the value of the register BC_SEL 0. For example, the first memory 212 is selected as the source memory if the value of the register BC_SEL 0 is "0" in logic, and the second memory 214 is selected as the source memory if the value of the register BC_SEL 0 is "1" in logic. The destination memory copies and stores the original image data, and is designated by the value of the register BC_SEL 1. For example, the first memory 212 is selected as the destination memory if the value of the register BC_SEL 1 is "0" in logic, and the second memory 214 is selected as the destination memory if the value of the register BC_SEL 1 is "1" in logic. The host processor 200 performs block copy operations as shown in FIGS. 3A to 3D by setting the values of the register BC_SEL 0 and register BC_SEL 1 according to a copy direction. FIG. 3*a* shows the case where a block copy is performed within the first memory 212 by setting the value of the register BC_SEL to "0" and the value of the register BC_SEL 1 to "0", respectively. FIG. 3*b* shows the case where a block copy is performed within the second memory 214 by setting the value of the register BC_SEL 0 to "1" and the value of the register BC_SEL 1 to "1", respectively. FIG. 3*c* shows the case where the contents of the second memory 214 are block-copied to the first memory 212 by setting the value of the register BC_SEL 0 to "1" and the value of the register BC_SEL 1 to "0", respectively. FIG. 3*d* shows the case where the contents of the first memory 212 are block-copied to the second memory 214 by setting the value of the register BC_SEL 0 to "0" and the value of the register BC_SEL 1 to "I", respectively.

The values of the registers (BCX1, BCY1) and (BCX2, BCY2) in the above table 1 are used to designate a source region of the source memory to be copied. The register (BCX1, BCY1) values are start coordinate values of the source region, and the register (BCX2, BCY2) values are end coordinate values of the source region. Thus, the size and position of a block to be copied are determined according to the values of the registers (BCX1, BCY1) and (BCX2, BCY2). The value of the register (BCDX, BCDY) in the above table 1 is a motion vector value for designating a destination region of the destination memory. The value of the register BC_START in the above table 1 is a copy start command value for starting a block copy operation when it is, for example, "1" in logic.

The DMAC 206 performs a DMA operation on the basis of the values of the register BC_SEL 0, register BC_SEL 1, register (BCX1, BCY1), register (BCX2, BCY2), register (BCDX, BCDY) and register BC_START to perform a block copy between the first and second memories 212 and 214, within the first memory 212 or within the second memory 214. When the DMAC 206 performs no block copy operation, the access selector 204 does not connect the DMAC 206 to the first and second memories 212 and 214 as shown in FIG. 2. Alternatively, when the DMAC 206 performs the DMA operation for the block copy operation, the access selector 204 selectively connects the DMAC 206 to the first and second memories 212 and 214 in such a way that the DMAC 206 is switched to the first and second memories 212 and 214 according to the DMA operation as indicated by dotted arrows 218, 220 in FIG. 2. The transfer of data between the memories by the DMAC is well known in the art and a detailed description thereof will thus be omitted.

Figure 4:
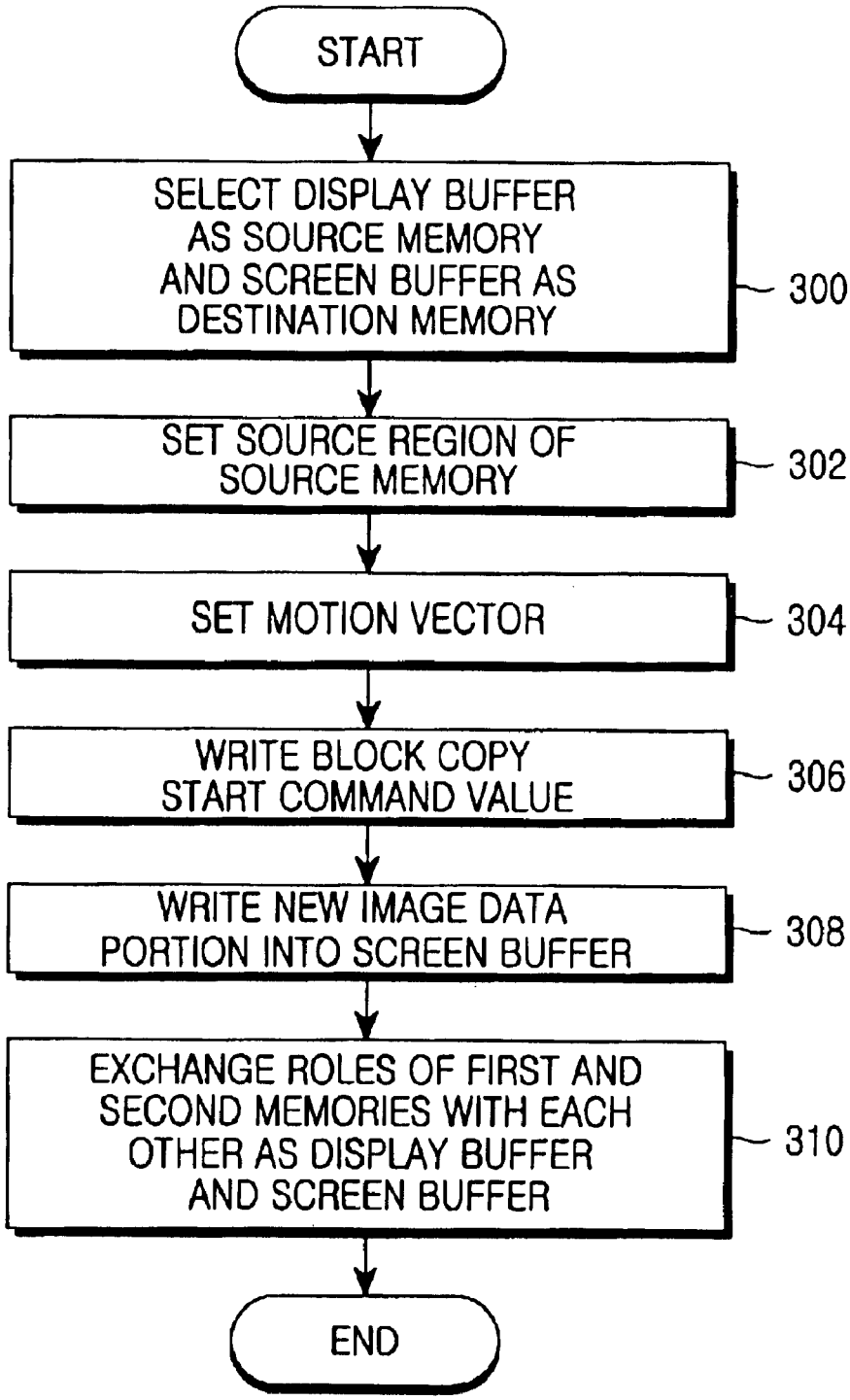
FIG. 4 is a flow chart illustrating the entire operation of the image data output control apparatus in accordance with the present invention.
Figure 5:
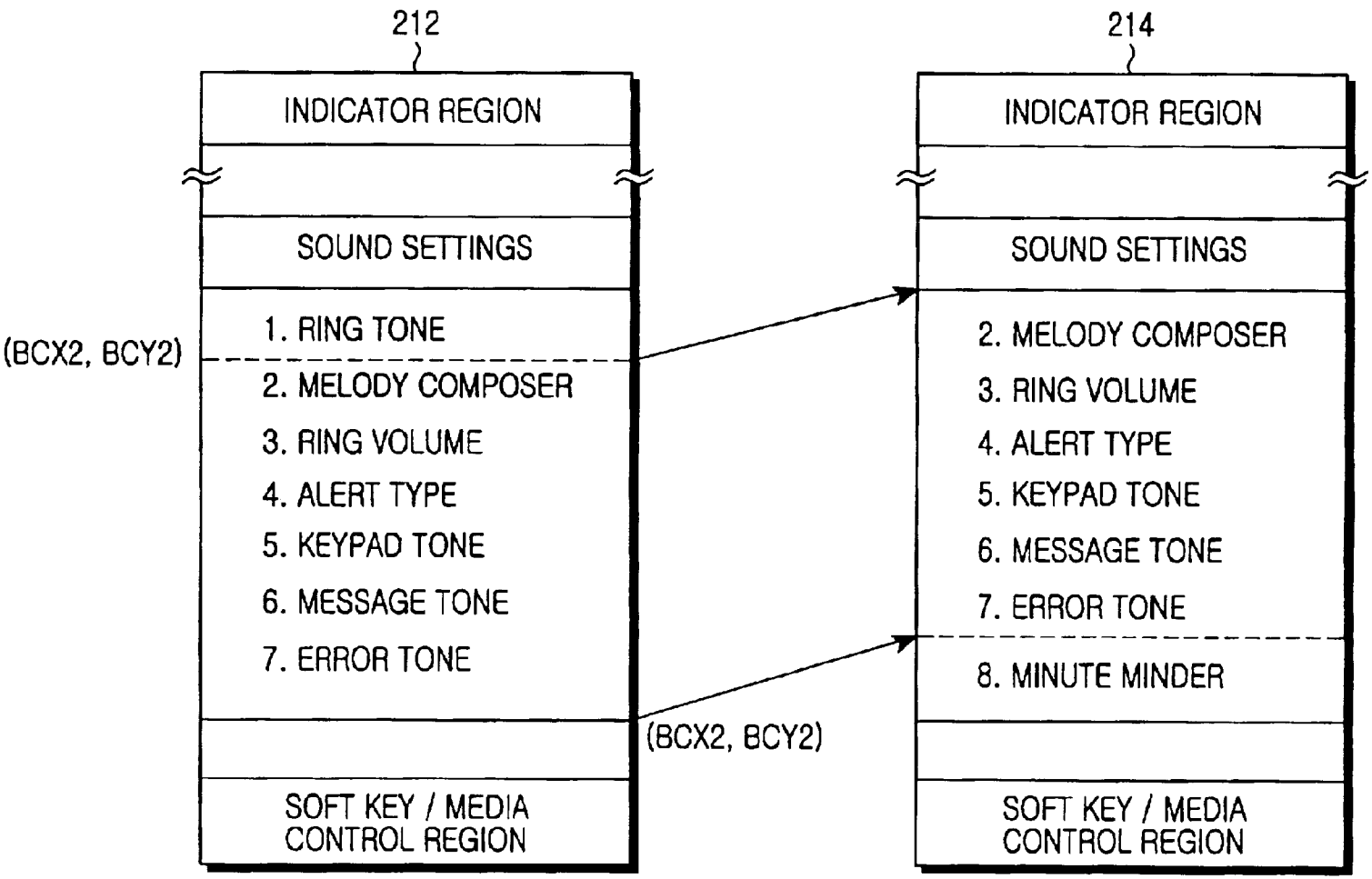
FIG. 5 is a view showing an example of the block copy operations of the image data output control apparatus in accordance with the present invention.

Now, the image data output control process as stated above will be described with reference to FIG. 4 which is a flow chart illustrating processing steps 300 to 310 of the host processor 200 and FIG. 5 which shows an example of the block copy operations where a mobile telephone user scrolls through a menu screen. In FIG. 5, the first memory 212 is a display buffer for outputting image data of a current screen to be displayed, and the second memory 214 is a screen buffer for constructing a next screen. In the case where image data in a source region of the first memory 212 corresponding to the values of the register (BCX1, BCY1) and register (BCX2, BCY2) is the same as that in the next screen, it is copied to a destination region of the second memory 214.

As the user scrolls through a menu screen displayed based on the image data stored in the first memory 212 of FIG. 5, image data of the next screen is written into the second memory 214 of FIG. 5 as shown. In this case, the host processor 200 selects the current display buffer, or the first memory 212, as a source memory and the current screen buffer, or the second memory 214, as a destination memory by setting the value of the register BC_SEL 0 to "0" and the value of the register BC_SEL 1 to "1", respectively, at step 300. Thereafter, the host processor 200 sets a source region of the first memory 212 corresponding to the source memory by the values of the register (BCX1, BCY1) and register (BCX2, BCY2) at step 302, and then sets a destination region of the second memory 214 by the values of the motion vector register (BCDX, BCDY) at step 304. Subsequently, the host processor 200 writes a copy start command value into the register BC_START at step 306, so the DMAC 206 performs a block copy in a hardware manner as described above. If the block copy is ended, then the access selector 204 releases the connection paths between the DMAC 206 and the first and second memories 212 and 214 so that the host processor 200 can again access the first and second memories 212 and 214. Thereafter, the host processor 200 constructs the next screen fully by directly writing a new image data portion other than the copied block into the screen buffer at step 308. Alternatively, in the case where the same image data for the next screen is present in another region of the source memory, the host processor may set that region and block-copy the contents thereof to the destination memory. Finally, the host processor changes the value of the register DISP_SEL at step 310, so the newly constructed next screen is rapidly displayed as the current screen is partially scrolled. As a result, the user may view screens being rapidly and naturally scrolled on the display unit.

As apparent from the above description, according to the present invention, a double buffering function is carried out to write image data of a next screen into a memory for a screen buffer other than a memory for a display buffer which outputs image data of a current screen, and then exchange the roles of the display buffer and screen buffer with each other. Owing to this double buffering function, screen updating may be rapidly conducted, for example, in the hardware, with no screen ripple or flickering phenomenon. Further, a block copy operation is performed to conduct the screen updating more rapidly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the DMAC 206 may not be used in an actual application in that it performs a block copy operation to rapidly construct a new screen when the new screen is similar to a current screen. In this case, the access selector 204 is configured to connect any one of the first and second memories 212 and 214 to the host processor 200.

What is claimed is:

1. An image data output control apparatus for a portable terminal, the apparatus comprising:

first and second memories each for buffering image data, the image data being displayed on one screen;

a host processor for selecting said first and second memories alternately as a display buffer for output of image data of a current screen and a screen buffer for storage of image data of a subsequent screen, writing said image data of said subsequent screen into said screen buffer to construct said subsequent screen, and outputting said image data of said current screen stored in said display buffer;

an output terminal for outputting image data from one of said first and second memories as image data for a screen to be displayed through a display unit;

an access selector for connecting one of said first and second memories to said host processor, said one of said first and second memories selected as said screen buffer by said host processor, a display selector for connecting another one of said first and second memories to said output terminal, said another one of said first and second memories selected as said display buffer by said host processor; and a host interface for providing an interface for access to said first and second memories by said host processor and for control of said access selector and display selector by said host processor.

2. An image data output control apparatus for a portable terminal, the apparatus comprising:

first and second memories each for buffering image data of one screen;

a host processor for selecting said first and second memories alternately as a display buffer for output of image data of a current screen and a screen buffer for storage of image data of a subsequent new screen, copying blocks of image data stored in said first and second memories to one of said first and second memories, writing said image data of said subsequent screen into said screen buffer to construct said subsequent screen, and outputting said image data of said current screen stored in said display buffer;

a direct memory access controller (DMAC) for copying a block of image data stored in said first and second memories to a destination region, the block of image data designated as a source region by said host processor;

an output terminal for outputting image data from one of said first and second memories as image data for a screen to be displayed through a display unit;

an access selector for connecting one of said first and second memories to said host processor, said one of said first and second memories selected as said screen buffer by said host processor, and for selectively connecting said first and second memories to said DMAC;

a display selector for connecting another one of said first and second memories to said output terminal, said another one of said first and second memories selected as said display buffer by said host processor; and a host interface for providing an interface for access to said first and second memories by said host processor and for control of said DMAC, access selector, and display selector by said host processor.

3. The image data output control apparatus as set forth in claim 2, wherein said host processor is adapted to control said DMAC to perform a block copy between said first and second memories or within said first or second memory.

* * * * *